US008570135B2

(12) United States Patent
Kwon et al.

(10) Patent No.: US 8,570,135 B2
(45) Date of Patent: Oct. 29, 2013

(54) TRANSFORMER AND DISPLAY DEVICE USING THE SAME

(75) Inventors: Soon Young Kwon, Gyunggi-do (KR); Ki Hung Nam, Gyunggi-do (KR); Sang Joon Seo, Gyunggi-do (KR)

(73) Assignee: Samsung Electro-Mechanics Co., Ltd., Suwon (KR)

( * ) Notice: Subject to any disclaimer, the term of this patent is extended or adjusted under 35 U.S.C. 154(b) by 0 days.

(21) Appl. No.: 13/409,962

(22) Filed: Mar. 1, 2012

(65) Prior Publication Data

US 2013/0002385 A1 Jan. 3, 2013

(30) Foreign Application Priority Data

Jun. 30, 2011 (KR) ..... 10-2011-0065121

(51) Int. Cl.
*H01F 27/29* (2006.01)
*H01F 27/28* (2006.01)
*H01F 27/30* (2006.01)

(52) U.S. Cl.
USPC ..... 336/192; 336/195; 336/198

(58) Field of Classification Search
USPC ..... 336/192, 195, 198
See application file for complete search history.

(56) References Cited

U.S. PATENT DOCUMENTS 3,014,164 A * 12/1961 Howenstine ..... 335/299
3,461,414 A * 8/1969 Fearon et al. ..... 336/192
4,156,888 A * 5/1979 Takahashi ..... 361/836
4,157,519 A * 6/1979 Foster ..... 336/192
4,363,014 A * 12/1982 Leach et al. ..... 336/90
4,588,973 A * 5/1986 Grah et al. ..... 336/192
5,774,036 A * 6/1998 Hrytzak et al. ..... 336/192
6,191,677 B1 * 2/2001 Orben et al. ..... 336/198
6,344,787 B1 * 2/2002 McGrane et al. ..... 336/198
6,396,379 B1 * 5/2002 Kondo et al. ..... 336/208
7,292,126 B2 * 11/2007 So ..... 336/200
7,612,644 B2 * 11/2009 Hsu et al. ..... 336/198

FOREIGN PATENT DOCUMENTS

JP 6-009117 U 2/1994
JP 09-270341 10/1997

* cited by examiner

*Primary Examiner* — Elvin G Enad
*Assistant Examiner* — Joselito Baisa
(74) *Attorney, Agent, or Firm* — McDermott Will & Emery LLP

(57) ABSTRACT

There is provided a transformer, and more particularly, a transformer capable of minimizing leakage inductance while satisfying a safety standard. The transformer includes: a pipe shaped body part including a plurality of coils wound around an outer peripheral surface thereof while being stacked thereon; and flange parts extended from both ends of the body part in an outer diameter direction thereof, wherein one of the flange parts formed at one end of a winding part includes at least one lead groove therein, the lead groove being formed by being cut to be extended in the outer diameter direction, and the lead groove is divided into at least two outlets by a dividing protrusion disposed in an inner portion thereof.

18 Claims, 6 Drawing Sheets

TRANSFORMER AND DISPLAY DEVICE USING THE SAME

CROSS-REFERENCE TO RELATED APPLICATIONS

This application claims the priority of Korean Patent Application No. 10-2011-0065121 filed on Jun. 30, 2011, in the Korean Intellectual Property Office, the disclosure of which is incorporated herein by reference.

BACKGROUND OF THE INVENTION

1. Field of the Invention

The present invention relates to a transformer, and more particularly, to a transformer capable of minimizing leakage inductance while satisfying a safety standard.

2. Description of the Related Art

Various kinds of power supplies are required in various electronic devices such as a television (TV), a monitor, a personal computer (PC), an office automation (OA) device, and the like. Therefore, these electronic devices generally include power supplies converting alternating current (AC) power supplied from the outside into a power required for each type of electronic appliance.

Among power supplies, a power supply using a switching mode (for example, a switch mode power supply (SMPS)) has recently been mainly used. This SMPS basically includes a switching transformer.

A switching transformer generally converts AC power of 85 to 265 V into direct current (DC) power of 3 to 30 V through high frequency oscillation at 25 to 100 KHz. Therefore, in a switching transformer, the sizes of a core and a bobbin may be significantly reduced as compared to a general transformer converting AC power of 85 to 265 V into AC power of 3 to 30 V through frequency oscillation of 50 to 60 Hz, and low voltage, low current DC power may be stably supplied to an electronic appliance. Accordingly, a switching transformer has recently been widely used in an electronic appliance that has tended to be miniaturized.

This switching transformer needs to be designed to have low leakage inductance in order to increase energy conversion efficiency. However, in accordance with the miniaturization of the switching transformer, it may be difficult to design a switching transformer having low leakage inductance.

In addition, when a compact transformer is manufactured, primary and secondary coils are disposed to be adjacent to each other, such that it may be difficult to satisfy a safety standard (such as Underwriters Laboratories (UL) safety standards) between the primary and secondary coils.

SUMMARY OF THE INVENTION

An object of the present invention provides a compact switching transformer.

Another aspect of the present invention provides a transformer capable of minimizing leakage inductance.

Another aspect of the present invention provides a transformer satisfying Underwriters Laboratories safety standards between primary and secondary coils.

According to an aspect of the present invention, there is provided a transformer including: a pipe shaped body part including a plurality of coils wound around an outer peripheral surface thereof while being stacked thereon; and flange parts extended from both ends of the body part in an outer diameter direction thereof, wherein one of the flange parts formed at one end of a winding part includes at least one lead groove therein, the lead groove being formed by being cut to be extended in the outer diameter direction, and the lead groove is divided into at least two outlets by a dividing protrusion disposed in an inner portion thereof.

The dividing protrusion may have a sidewall having an inclined surface facing a sidewall of the lead groove.

The inclined surface forming the sidewall of the dividing protrusion may have an angle of 45° or less with respect to the coils wound in the winding part.

The transformer may further include a terminal connection part extended from an end of the winding part by a predetermined distance and including a plurality of external connection terminals connected thereto, and the dividing protrusion may protrude from the terminal connection part toward the lead groove.

The dividing protrusion may have a distal end disposed within the lead groove, and may have a larger cross-sectional area in a portion thereof adjacent to the terminal connection part than in a portion thereof adjacent to the distal end thereof.

A surface of the dividing protrusion formed by the distal end thereof may be disposed on the same plane as an inner surface of the flange part having the lead groove formed therein.

The transformer may further include a catch protrusion protruding from at least one of the terminal connection part and the flange part, and lead wires led through the lead groove may be disposed in an altered direction while being supported by the catch protrusion.

The outlets and the coils wound in the winding part may have an angle of 45° or less formed therebetween.

Lead wires of the coils may lead to the outside of the winding part through the outlets formed in a coil winding direction.

The terminal connection part may include at least one catch groove extended from the lead groove and cut to have a width extended beyond that of the lead groove in a coil winding direction, and lead wires of the coils may lead to the outside while traversing the catch groove in a length direction thereof.

The dividing protrusion may protrude from an outer surface of the body part in the outer diameter direction thereof.

The dividing protrusion may have the same thickness as that of the flange part having the lead groove formed therein.

The dividing protrusion may have a sidewall having an inclined surface facing a sidewall of the lead groove.

The transformer may further include external connection terminals connected to a distal end of the flange part having the lead groove formed therein, to thereby be electrically connected to lead wires of the coils.

At least one of a sidewall of the lead groove and a sidewall of the dividing protrusion facing each other may be formed as an inclined surface.

The inclined surface may have an angle of 45° or less with respect to the coils wound in the winding part.

The winding part may include a plurality of winding spaces divided by at least one partition wall formed on the outer peripheral surface of the body part, and the coils may be wound in the plurality of winding spaces partitioned by the at least one partition wall in a distributed scheme.

The coils may include a plurality of primary coils and a plurality of secondary coils, and the plurality of secondary coils may be continuously wound to be stacked while being interposed between the plurality of primary coils.

According to another aspect of the present invention, there is provided a display device including: a power supply including at least one transformer of any one of claims 1 to 18 mounted on a substrate thereof; a display panel receiving power from the power supply; and a cover protecting the display panel and the power supply.

The coils of the transformer may be wound so as to be parallel to the substrate of the power supply.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
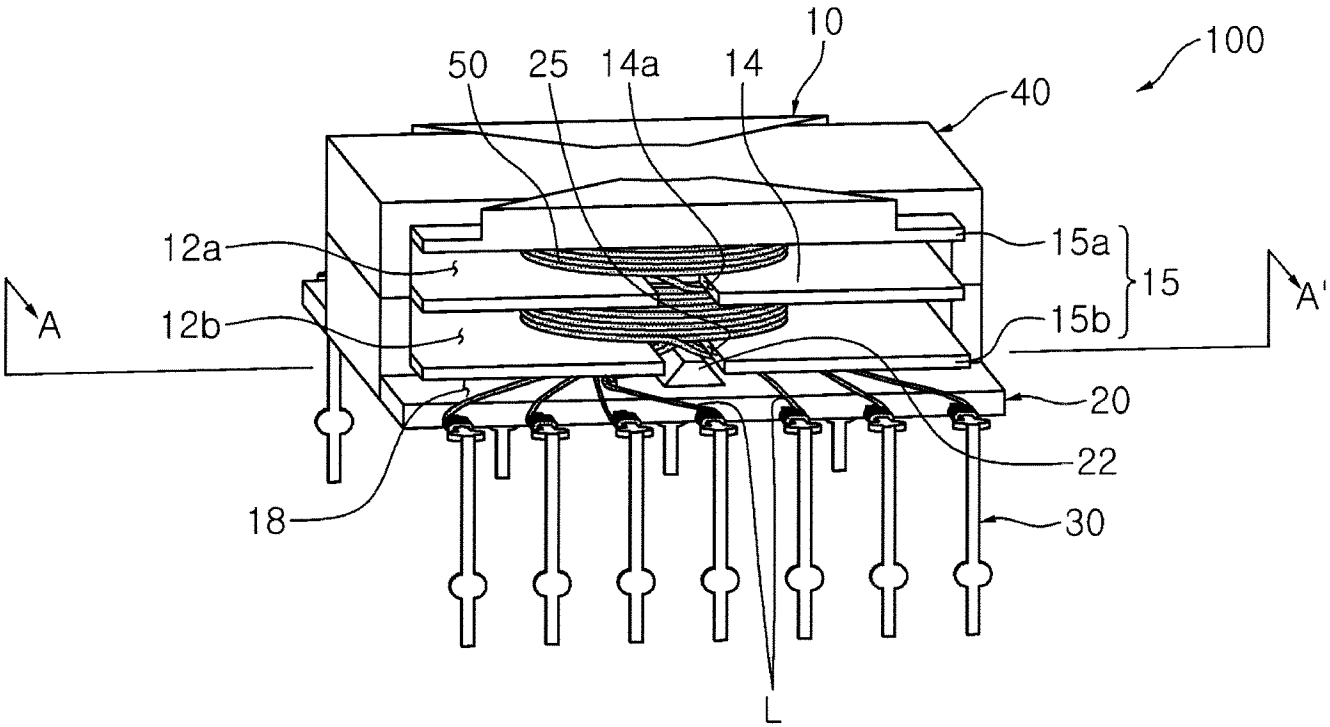
FIG. 1 is a perspective view schematically showing a transformer according to an embodiment of the present invention.

Prior to a detailed description of the present invention, the terms or words, which are used in the specification and claims to be described below, should not be construed as having typical or dictionary meanings. The terms or words should be construed in conformity with the technical idea of the present invention on the basis of the principle that the inventor(s) can appropriately define terms in order to describe his or her invention in the best way. Embodiments described in the specification and structures illustrated in drawings are merely exemplary embodiments of the present invention. Thus, it is intended that the present invention covers the modifications and variations of this invention, provided they fall within the scope of their equivalents at the time of filing this application.

Exemplary embodiments of the present invention will be described in detail with reference to the accompanying drawings. The same reference numerals will be used throughout to designate the same or like elements in the accompanying drawings. Moreover, detailed descriptions related to well-known functions or configurations will be ruled out in order not to unnecessarily obscure subject matters of the present invention. In the drawings, the shapes and dimensions of some elements may be exaggerated, omitted or schematically illustrated. Also, the size of each element does not entirely reflect an actual size.

Meanwhile, a safety standard mentioned in the present embodiment means a standard defined by American underwriters with respect to structures of electronic devices, components embedded in the electronic devices, a wiring method of the electronic devices, or the like, that is, underwriters laboratories (UL). However, the invention is not limited thereto.

Hereinafter, embodiments of the present invention will be described in detail with reference to the accompanying drawings.

Figure 2:
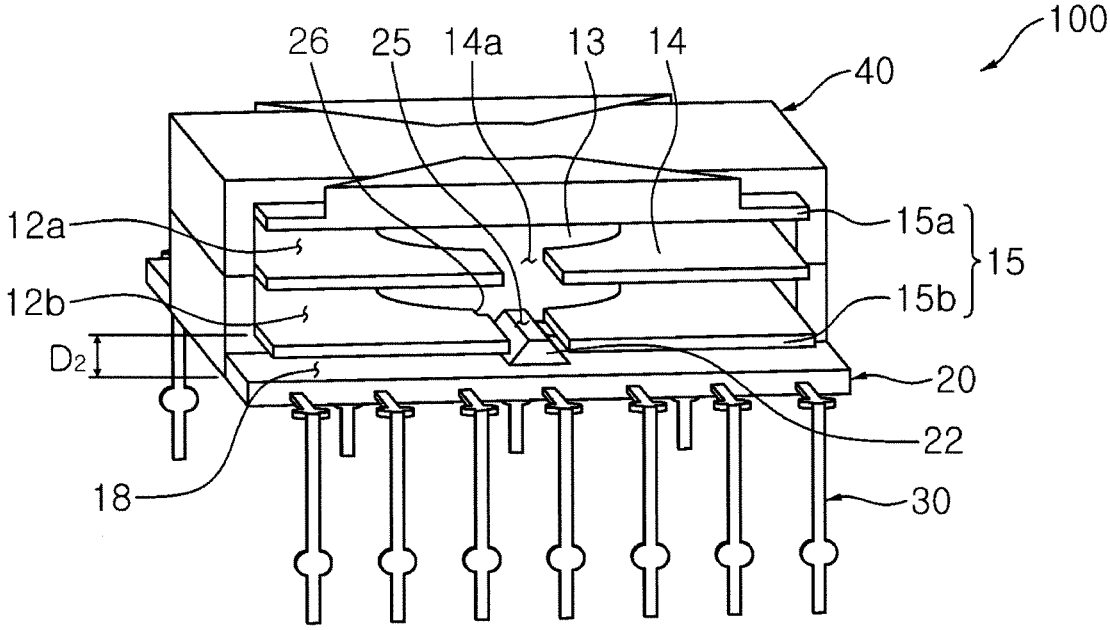
FIGS. 2 and 3 are perspective views showing the transformer of FIG. 1 in a state in which a coil is omitted.
Figure 3:
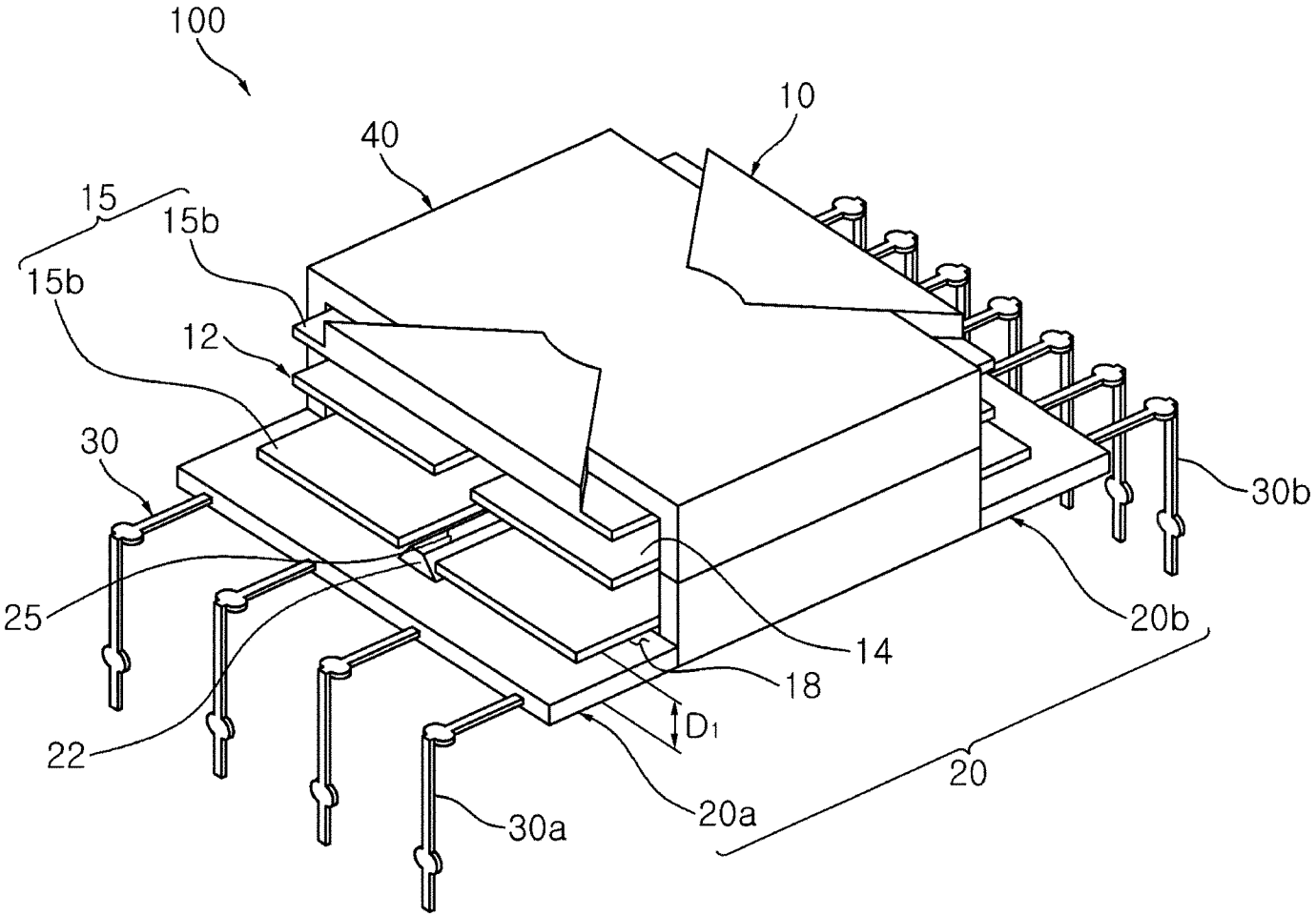

FIG. 1 is a perspective view schematically showing a transformer according to an embodiment of the present invention; and FIGS. 2 and 3 are perspective views showing the transformer of FIG. 1 in a state in which a coil is omitted.

Figure 4:
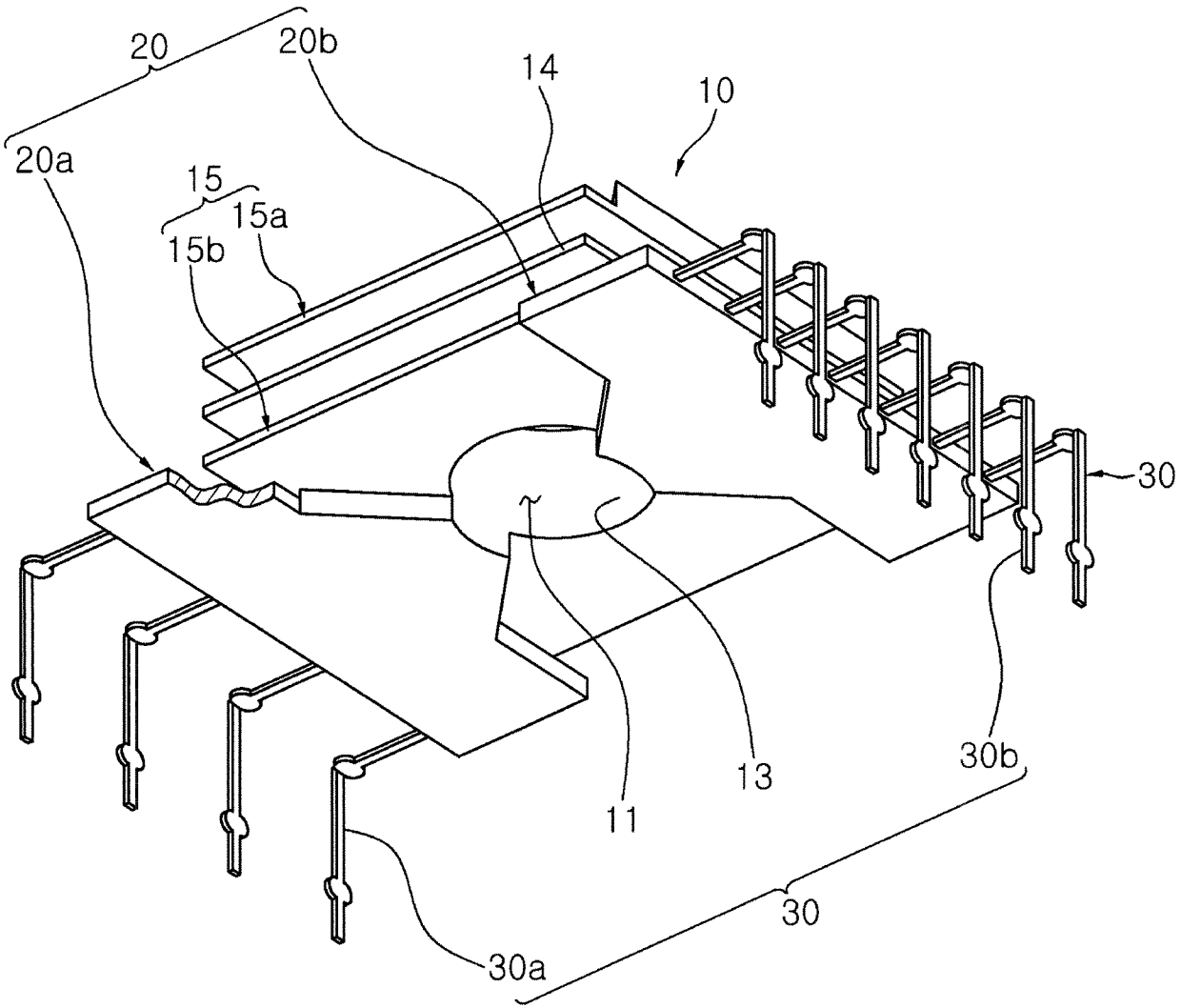
FIG. 4 is a perspective view schematically showing a lower surface of a bobbin shown in FIG. 3.
Figure 5:
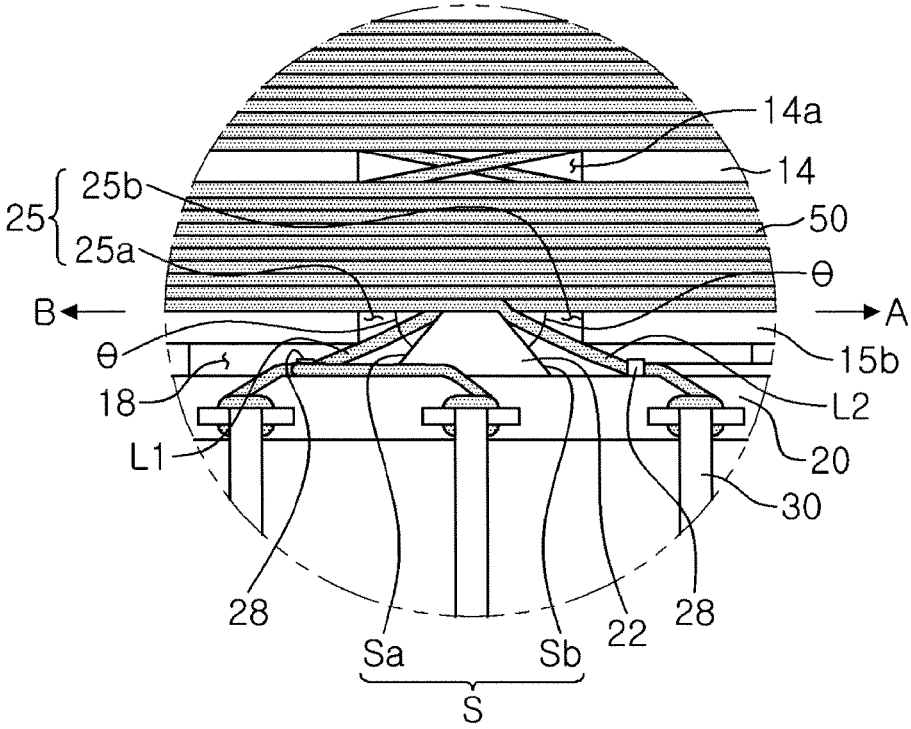
FIG. 5 is a partial side view partially showing a side of the transformer of FIG. 1.

FIG. 4 is a perspective view schematically showing a lower surface of a bobbin shown in FIG. 3; and FIG. 5 is a partial side view partially showing a side of the transformer of FIG. 1.

Referring to FIGS. 1 through 5, a transformer 100 according to an embodiment of the present invention, which is an insulating type switching transformer, includes a bobbin 10, a core 40, and a coil 50.

The bobbin 10 includes a winding part 12 having the coil 50 wound therein and a terminal connection part 20 spaced apart from one end of the winding part 12 by a predetermined interval.

The winding part 12 may include a body part 13 having a pipe shape and a flange part 15 extended from both ends of the body part 13 in an outer diameter direction thereof.

The body part 13 may include a through hole 11 formed in an inner portion thereof and at least one partition wall 14 formed on an outer peripheral surface thereof, in which the through hole 11 includes the core 40 partially inserted therein and the partition wall 14 partitions a space in a length direction of the body part 13. In this configuration, each of the spaces partitioned by the partition wall 14 may include the coil 50 wound therein.

The winding part 12 according to the present embodiment includes a single partition wall 14. Therefore, the winding part 12 according to the present embodiment includes two partitioned spaces 12*a* and 12*b*. However, the present invention is not limited thereto. Various numbers of spaces may be formed and used through various numbers of partition walls 14 as necessary.

In addition, the partition wall 14 according to the present embodiment includes at least one skip groove 14*a* formed therein so that the coil 50 wound in the space 12*a* (hereinafter, referred to as an upper space) may skip the partition wall 14 to thereby be wound in the other adjacent space 12*b* (hereinafter, referred to as a lower space).

The skip groove 14*a* may have a shape in which a portion of the partition wall 14 is completely cut and removed so that an outer surface of the body part 13 is exposed. In addition, the skip groove 14*a* may have a width wider than a thickness of the partition wall 14. The skip groove 14*a* may be formed as a pair corresponding to positions of terminal connection parts 20*a* and 20*b* to be described below.

The partition wall 14 according to the present embodiment is provided in order to approximately uniformly dispose and wind the coil 50 in the partitioned spaces 12*a* and 12*b*. Therefore, the partition wall may have various thicknesses and be made of various materials as long as a shape thereof may be maintained.

Meanwhile, although the present embodiment describes a case in which the partition wall 14 is formed integrally with the bobbin 10 by way of example, the present invention is not limited thereto but may be variously applied. For example, the partition wall 14 may be formed as an independent separate member and be then coupled to the bobbin 10.

The partition wall 14 according to the present embodiment may have approximately the same shape as that of the flange part 15.

The flange part 15 protrudes in a manner in which it is extended from both ends, that is, upper and lower ends, of the body part 13 in the outer diameter direction thereof. The flange part 15 according to the present embodiment may be divided into an upper flange part 15*a* and a lower flange part 15*b* according to a formation position thereof.

In addition, spaces between the outer peripheral surface of the body part 13 and the upper and lower flange parts 15*a* and 15*b* are formed as the spaces 12*a* and 12*b* in which the coil 50 is wound. Therefore, the flange part 15 serves to protect the coil 50 from the outside and secure insulation properties between the coil 50 and the outside, while simultaneously serving to support the coil 50 wound in the winding spaces 12*a* and 12*b* at both sides thereof.

In addition, the lower flange part 15*b* according to the present embodiment may include a lead groove 25 and a catch groove 26 in order to guide a lead wire L of the coil 50 wound in the winding part 12 to an external connection terminal 30.

The lead groove 25 is used in a case in which the lead wire L of the coil 50 wound around the winding part 12 leads to a lower portion of the lower flange part 15*b*, as shown in FIG. 3. To this end, the lead groove 25 according to the present embodiment may be formed in a shape in which a portion of the lower flange part 15*b* is completely cut so that the outer peripheral surface of the body part 13 is exposed.

In addition, the lead groove 25 may have a width wider than a thickness of the lower flange part 15*b*.

Particularly, the lead groove 25 according to the present embodiment is formed at a position corresponding to that of the skip groove 14*a* of the partition wall 14. More specifically, the lead groove 25 may be formed at a position on which the skip groove 14*a* projects downwardly.

The lead groove 25 may be formed as a pair corresponding to the position of the lower flange part 15*b*, similar to the skip groove 14*a*.

In addition, each of the lead grooves 25 according to the present embodiment may be divided into two outlets 25*a* and 25*b* through which the lead wire L leads by a dividing protrusion 22 of the terminal connection part 20 to be described below. A detailed description thereof will be provided in connection with a description of the terminal connection part 20 to be described below.

The catch groove 26 may be formed to be extended from the lead groove 25. That is, the catch groove 26 may traverse the lead groove 25 in a width direction to thereby have a width extended beyond that of the lead groove 25 and allowing the coil 50 to be led to the outside while penetrating therethrough.

The catch groove 26 may be extended from both edges of the lead groove 25 or from only one edge thereof in the width direction thereof.

Edge portions of the lead groove 25 and the catch groove 26, connected to a lower surface of the lower flange part 15*b*, may be formed as inclined surfaces or curved surfaces through chamfering, or the like. Therefore, the excessive bending of the lead wire L led through the lead groove 25 and the catch groove 26 by the edge portions thereof may be minimized.

The terminal connection part 20 is formed under the lower flange part 15*b* so as to be spaced apart therefrom by a predetermined interval. More specifically, the terminal connection part 20 may be extended downwardly from the lower flange part 15*b* by a predetermined distance and protrude from the extended distal end in the outer diameter direction of the body part 13 to be parallel to the lower flange part 15*b*.

The terminal connection part 20 may include a primary terminal connection part 20*a* and a secondary terminal connection part 20*b*, and the primary and secondary terminal connection parts 20*a* and 20*b* may include primary and secondary coils respectively connected thereto. However, the present invention is not limited thereto but may be variously applied.

A space between the primary and secondary terminal connection parts 20*a* and 20*b* may be used as a space into which a portion of the core 40 (that is, a lower surface of the core) is inserted. Therefore, the space between the primary and secondary terminal connection parts 20*a* and 20*b* may have a shape corresponding to an outer shape of the lower surface of the core 40.

In addition, the terminal connection part 20 according to the present embodiment includes the dividing protrusion 22 and a catch protrusion 28 protruding from an inner peripheral surface thereof.

The dividing protrusion 22 protrudes toward the lead groove 25 of the lower flange part 15*b* and a portion thereof is disposed within the lead groove 25.

The dividing protrusion 22 may be elongated in the length direction of the lead groove 25 cut to be extended. However, the present invention is not limited thereto. A plurality of divided protrusions may protrude in a manner in which they are disposed in a row.

In addition, a width of a surface of the dividing protrusion 22 formed by a distal end thereof may be narrower than that of the lead grove 25, and the surface of the dividing protrusion 22 may be disposed on approximately the same plane as the inner surface of the lower flange part 15*b*. In addition, the center of the dividing protrusion 22 is disposed at the center of the lead groove 25.

The lead groove 25 is divided into the two outlets 25*a* and 25*b* by the dividing protrusion 22.

These outlets 25*a* and 25*b* are used as paths through which the lead wire L is led-in or led-out. Therefore, each of the two outlets 25*a* and 25*b* is formed as a space larger than a diameter of the lead wire L.

Particularly, the dividing protrusion 22 according to the present embodiment may have a trapezoidal cross section. That is, a portion of the dividing protrusion 22 adjacent to the terminal connection part 20 may have a larger cross-sectional area than that of the distal end of the dividing protrusion 22. In addition, sidewalls of the dividing protrusion 22 facing sidewalls of the lead groove 25 in the length direction thereof may be formed as inclined surfaces (S).

Here, the sidewall of the dividing protrusion 22 may have an angle θ of 45° or less with respect to an inner surface of the lower flange part 15*b* or the coil 50 wound in the winding part 12. Therefore, the outlets 25*a* and 25*b* also have an angle of 45° or less with respect to the coil 50 wound in the winding part 12.

This configuration was derived in order to satisfy the UL safety standard. A detailed description thereof will be provided in connection with a description of the coil 50.

The catch protrusion 28 may protrude from the inner surface of the terminal connection part 20.

The catch protrusion 28 is provided to guide the lead wires L leading to a lead wire skip part 18 so that the lead wires L may be easily disposed toward the external connection terminals 30 within the lead wire skip part 18. Therefore, the catch protrusion 28 may protrude beyond the diameter of the lead wire L of the coil 50 so that the coil 50 is firmly supported by the catch protrusion 28 while being caught by the catch protrusion 28.

Due to the catch protrusions 28, the lead wires L led through the lead groove 25 or the catch groove 26 may be disposed in various directions as necessary.

Particularly, the catch protrusions 28 according to the present embodiment are provided in order to easily alter the direction in which the lead wires L led through the outlets 25*a* and 25*b* are disposed.

Therefore, when all of the external connection terminals 30 to be connected with the lead wires L are disposed in the direction in which the lead wires L are led through the outlets 25*a* and 25*b*, the catch protrusion 28 may be omitted. However, when the external connection terminals 30 are disposed in a direction opposite to the direction in which the lead wires L are led, the lead wires L may be guided in an altered direction while being supported by the catch protrusions 28.

To this end, at least one of the catch protrusions 28 may be disposed to be adjacent to the outlets 25*a* and 25*b*.

Meanwhile, although the present embodiment describes a case in which the catch protrusions 28 protrude from the inner surface of the terminal connection part 20 by way of example, the present invention is not limited thereto. That is, various applications may be made. For example, a plurality of catch protrusions 28 may protrude from an outer surface (that is, a lower surface) of the lower flange part 15*b* or protrude from both of the terminal connection part 20 and the lower flange part 15.

The terminal connection part 20 may include the plurality of external connection terminals 30 connected thereto. The external connection terminals 30 may protrude outwardly from the terminal connection part 20 and have various shapes according to a shape or a structure of the transformer 100 or a structure of a substrate having the transformer 100 mounted thereon.

That is, the external connection terminals 30 according to the present embodiment are connected to the terminal connection part 20 such that they protrude from the terminal connection part 20 in the outer diameter direction of the body part 13. However, the present invention is not limited thereto. The external connection terminals 30 may be formed at various positions as necessary. For example, the external connection terminals 30 may be connected to the terminal connection part 20 such that they protrude downwardly from the lower surface of the terminal connection part 20.

In addition, the external connection terminal 30 according to the present embodiment includes an input terminal 30*a* and an output terminal 30*b*.

The input terminal 30*a* is connected to the primary terminal connection part 20*a*, and is connected to a lead wire L of a primary coil 51 (See FIG. 6) to be described below to thereby supply power to the primary coil 51. In addition, the output terminal 30*b* is connected to the secondary terminal connection part 20*b*, and is connected to a lead wire L of a secondary coil 52 (See FIG. 6) to be described below to thereby supply output power, set according to a turn ratio between the secondary coil 52 and the primary coil 51, to the outside.

The external connection terminal 30 according to the present embodiment includes a plurality of (for example, four) input terminals 30*a* and a plurality of (for example, seven) output terminals 30*b*. This configuration has been developed because the transformer 100 according to the present embodiment has a structure in which the plurality of coils 50 are wound in a single winding part 12 while being stacked therein. Therefore, in the transformer 100 according to the present embodiment, the number of external connection terminals 30 is not limited to the above-mentioned number.

The input terminal 30*a* and the output terminal 30*b* may have the same shape or have different shapes as necessary. In addition, the external connection terminal 30 according to the present embodiment may be variously modified as long as the lead wire L may be easily connected thereto.

Further, in the transformer 100 according to the present embodiment, a space between the lower flange part 15*b* and the terminal connection part 20 is used as the lead wire skip part 18, in which the lead wire L of the coil 50 is disposed.

That is, the lead wire L of the coil 50 wound in the winding part 12 leads to the lower portion of the lower flange part 15*b* through the lead groove 25 or the catch groove 26 of the lower flange part 15*b* to thereby be disposed in the lead wire skip part 18. In addition, the lead wire L is disposed in an altered direction within the lead wire skip part 18 to thereby be connected to the external connection terminal 30.

Here, the lead wire L may be inserted into the catch groove 26 formed in the lower flange part 15*b* and be then disposed in an altered direction while being supported by a sidewall of the catch groove 26 or of the lead groove 25. In addition, the lead wire L may be disposed in an altered direction while being supported by the catch protrusion 28 formed on the terminal connection part 20.

As described above, the bobbin 10 includes the lead groove 25, the catch groove 26, and the lead wire skip part 18, whereby the transformer 100 according to the present embodiment may minimize leakage inductance generated at the time of driving thereof.

In the case of the transformer according to the related art, the lead wire of the coil is generally led to the outside along an inner wall surface of a winding part in which the coil is wound, such that the winding coil and the lead wire thereof are in contact with each other.

Therefore, the coil, when being wound, is bent in a contact portion of the coil and its lead wire, and the bending, that is, non-uniform winding, of the coil causes an increase in leakage inductance.

However, in the transformer 100 according to the present embodiment, the lead wire L of the coil 50 is not disposed within the winding part 12 but directly leads to the lead wire skip part 18 in a vertical direction through the lead groove 25 and the catch groove 26.

Therefore, the coil 50 may be entirely uniformly wound in the winding part 12. Accordingly, the leakage inductance, generated due to the bending of the coil 50 or the like, may be minimized.

In addition, the separate lead wire skip part 18 is provided, whereby the plurality of lead wires L may be more easily disposed therein. In addition, since the lead wires L are disposed within the lead wire skip part 18, exposure of the lead wires L to the outside may be minimized, such that damages to the lead wires L due to physical contact between the lead wires L and the outside may be prevented.

Meanwhile, as described above, the lead wires L of the coils 50 are disposed in the lead wire skip part 18. Therefore, the lower flange part 15*b* may protrude outwardly to be longer than the upper flange part 15*a* in order to secure insulation properties (for example, a creepage distance, or the like) between the lead wires L and the coils 50 wound in the winding part 12. That is, the lower flange part 15*b* may have an increased area in a direction in which the lead groove 25 is formed to thereby have an area greater than that of the upper flange part 15*a*.

Further, in the bobbin 10 according to the present invention, a spaced distance between the terminal connection part 20 and the lower flange part 15*b* corresponds to the thickness of the core 40. More specifically, a vertical distance D1 (See FIG. 3) from the lower surface of the lower flange part 15*b* to the lower surface of the terminal connection part 20 may be equal to or smaller than a thickness D2 (See FIG. 2) of the lower surface of the core 40. Therefore, the lower surface of the terminal connection part 20 is disposed on the same plane as the lower surface of the core 40 or is disposed in a position higher than the lower surface of the core 40.

Due to this configuration, even in the case that the transformer 100 according to the present embodiment further includes the lead wire skip part 18 as compared to the transformer 100 according to the related art, it may have the same height (that is, the height of the core) as that of the related art transformer in the entire size of the transformer.

Meanwhile, the present invention is not limited to the above-mentioned configuration but may be variously applied. For example, the lower surface of the terminal connection part 20 may also be disposed in a position lower than the lower surface of the core 40.

In addition, although the present embodiment describes a case in which the terminal connection part 20 and the winding part 12 are formed integrally with each other by way of example, the present invention is not limited thereto but may be variously applied. For example, the winding part 12 and the terminal connection part 20 may be individually manufactured and be then coupled to each other to thereby form an integral bobbin.

The bobbin 10 according to the present embodiment may be easily manufactured by an injection molding method. However, a method of forming the bobbin 10 is not limited thereto. In addition, the bobbin 10 according to the present embodiment may be made of an insulating resin and be made of a material having high heat resistance and high voltage resistance. As a material of the bobbin 10, polyphenylenesulfide (PPS), liquid crystal polyester (LCP), polybutyleneterephthalate (PBT), polyethyleneterephthalate (PET), phenolic resin, and the like, may be used.

The above-described configuration of the bobbin 10 according to the present embodiment has been developed in consideration of a case in which the coil 50 is automatically wound in the bobbin 10.

That is, due to the configuration of the bobbin 10 according to the present embodiment, processes of winding the coil 50 in the bobbin 10, skipping the lead wire L of the coil 50 to the lead wire skip part 18 through the lead groove 25 and the catch groove 26, changing a route of the lead wire L through the catch protrusion 28 to thereby lead the lead wire L in a direction in which the external connection terminal 30 is formed, and connecting the lead wire L to the external connection terminal 30, and the like, may be automatically performed through a separate automatic winding device (not shown).

The core 40 is partially inserted into the through-hole 11 formed in an inner portion of the bobbin 10 and is electromagnetically coupled to the coil 50 to thereby form a magnetic path.

The core 40 according to the present embodiment is configured in a pair. The pair of cores 40 may be partially inserted into the through-hole 11 of the bobbin 10 to thereby be coupled to each other so as to face each other. As the core 40, an 'EE' core, an 'EI' core, a 'UU' core, a 'UI' core, and the like, according to a shape thereof may be used.

In addition, the core 40 according to the present embodiment may have an hourglass shape in which a portion thereof contacting the flange part 15 is partially concave. However, the present invention is not limited thereto.

The core 40 may be made of Mn—Zn based ferrite having higher permeability, lower loss, higher saturation magnetic flux density, higher stability, and lower production costs, as compared to other materials. However, in the embodiment of the present invention, the shape or material of the core 40 is not limited.

Meanwhile, although not shown, an insulating tape may be interposed between the bobbin 10 and the core 40 in order to secure insulation properties between the coil 50 wound in the bobbin 10 and the core 40.

The insulating tape may be interposed between the bobbin 10 and the core 40 corresponding to the entire inner surface of the core 40 facing the bobbin 10 or be partially interposed therebetween only at a portion at which the coil 50 and the core 40 face each other.

The coil 50 may be wound in the winding part 12 of the bobbin 10 and include the primary and secondary coils.

Figure 6:
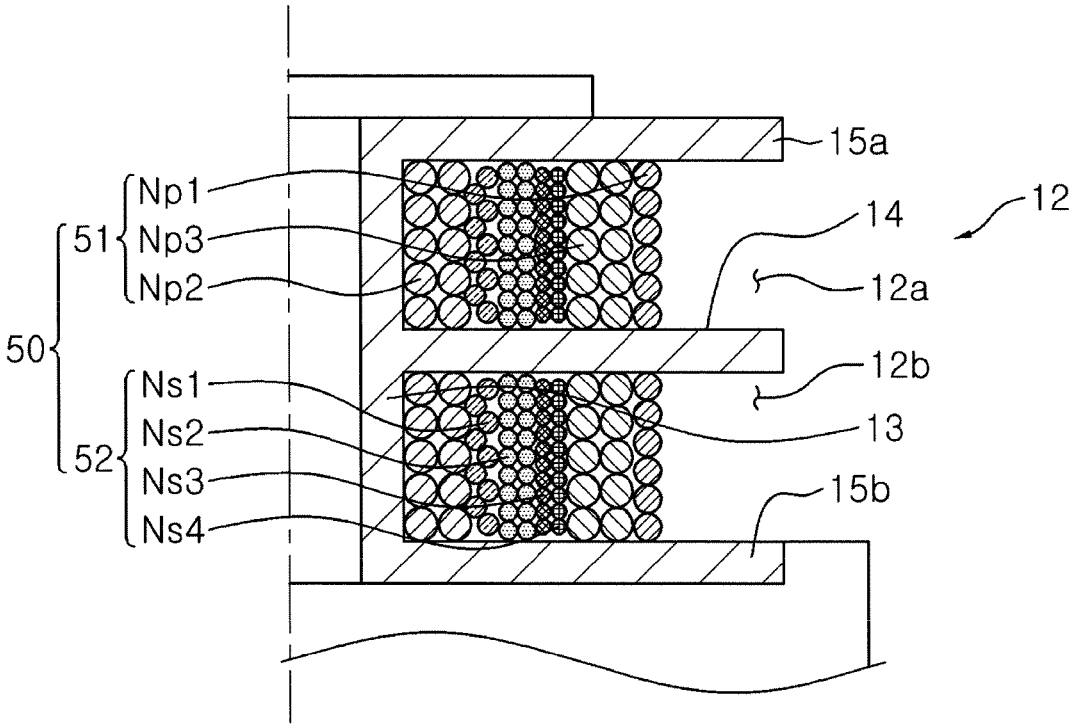
FIG. 6 is a partial cross-sectional view taken along line A-A' of FIG. 1.

FIG. 6 is a partial cross-sectional view taken along line A-A' of FIG. 1. Referring to FIG. 6, the primary coil 51 may include a plurality of coils Np1, Np2, and Np3 that are electrically insulated from each other. The present embodiment describes a case in which the primary coil 51 is formed by individually winding each of three independent coils Np1, Np2, and Np3 in a single winding part 12 by way of example. Therefore, in the primary coil 51 according to the present embodiment, a total of six lead wires L lead to thereby be connected to the external connection terminals 30.

As shown in FIG. 6, the coils Np1, Np2, and Np3 having a similar thickness are used as the primary coil 51. However, the present invention is not limited thereto. Each of the coils Np1, Np2, and Np3 configuring the primary coil 51 may also have different thicknesses as necessary. In addition, the respective coils Np1, Np2, and Np3 may have the same number of turns or have a different number of turns as necessary.

Further, in the transformer 100 according to the present invention, when a voltage is applied to at least any one (for example, Np2 or Np3) of the plurality of primary coils Np1, Np2, and Np3, a voltage may also be drawn into the other primary coil (for example, Np1) by electromagnetic induction. Therefore, the transformer 100 may also be used in a display device to be described below.

As described above, in the transformer 100 according to the present embodiment, the primary coil 51 is configured of the plurality of coils Np1, Np2, and Np3, such that various voltages may be applied and be drawn through the secondary coil 52 correspondingly.

Meanwhile, the primary coil 51 according to the present embodiment is not limited to the three independent coils Np1, Np2, and Np3 as described in the present embodiment but may include various numbers of coils as necessary.

The secondary coil 52 is wound in the winding part 12, similar to the primary coil 51. Particularly, the secondary coil 52 according to the present embodiment is wound while being stacked in a sandwich form between the primary coils 51.

The secondary coil 52 may be formed by winding a plurality of coils electrically insulated from each other, similar to the primary coil 51.

More specifically, the present embodiment describes a case in which the secondary coil 52 includes four independent coils Ns1, Ns2, Ns3, and Ns4 electrically insulated from each other by way of example. Therefore, in the secondary coil 52 according to the present embodiment, a total of eight lead wires L may lead to thereby be connected to the external connection terminals 30.

In addition, as the individual coils Ns1, Ns2, Ns3, and Ns4 of the secondary coil 52, coils having the same thickness or coils having different thicknesses may be selectively used. The individual coils Ns1, Ns2, Ns3, and Ns4 may also have the same number of turns or have a different number of turns as necessary.

The individual coils Np1 to Ns4 according to the present embodiment are wound in the spaces 12*a* and 12*b* divided by the partition wall 14 in a uniformly distributed scheme.

More specifically, the individual coils Np1 to Ns4 are wound to have the same number of turns in each of the upper and lower winding spaces 12*a* and 12*b*, and are disposed to vertically form the same layer as shown in FIG. 6. Therefore, the individual coils Np1 to Ns4 wound in the upper and lower winding spaces 12*a* and 12*b* are wound to have the same shape.

Here, when the turns of the individual coils Np1 to Ns4 are set as odd numbers, the corresponding coils Np1 to Ns4 may be wound to have a difference in the number of turns in the ratio within 10% of the total turns.

This configuration is designed to minimize the generation of leakage inductance in the transformer 100 according to the wound state of the coil 50.

Generally, when the coils are wound in the winding part of the bobbin, they may not be wound uniformly but may be wound while being inclined toward one side or while being non-uniformly disposed. In this case, leakage inductance in the transformer may increase. In addition, this problem may be intensified as the space of the winding part becomes large.

Therefore, in the transformer 100 according to the present embodiment, the winding part 12 is partitioned into the spaces 12*a* and 12*b* by the partition wall 14 in order to minimize leakage inductance generated for the above-mentioned reason. In addition, the coils 50 are wound in the respective partitioned spaces 12*a* and 12*b* as uniform as possible.

For example, when Ns1 has 18 total turns, it is wound nine times in the upper winding space 12*a* and nine times in the lower winding space 12*b*, such that it is disposed in a uniformly distributed scheme.

In addition, when the turns of Ns1 are set as an odd number (for example, Ns 1 has fifty turns), Ns1 may be wound twenty three times in the upper winding space 12*a* and twenty seven times in the lower winding space 12*b* so as to have a difference in the number of turns in the ratio within 10% as described above.

As described above, in the case of the transformer 100 according to the present embodiment, even if turns or a thickness of the coil are smaller than widths of the winding spaces 12*a* and 12*b* such that the coil (for example, Ns1) may not be densely wound within the winding part 12, the winding part 12 is partitioned into the plurality of spaces 12*a* and 12*b*, such that the coil (for example, Ns1) may be wound so as to be disposed in the same position within the respective partitioned spaces 12*a* and 12*b* in a distributed scheme without being relatively more wound in any one side.

That is, in the transformer 100 according to the present embodiment, the respective independent coils Np1 to Ns4 are disposed in the upper and lower winding spaces 12*a* and 12*b* in a uniformly distributed scheme according to the winding scheme and the structure of the bobbin 10 described above. Therefore, in the entire winding part 12, a phenomenon in which the coils Np1 to Ns4 are relatively more wound in any one side or are non-uniformly wound while being spaced apart from each other may be prevented. As a result, leakage inductance generated due to the non-uniform winding of the coils Np1 to Ns4 may be minimized.

Further, in the transformer 100 according to the present embodiment, the dividing protrusion 22 is formed within the lead groove 25, such that the lead wires L are led from the winding part 12 to the lead wire skip part 18 through the lead groove 25 while supporting the sidewall, that is, the inclined surface S of the dividing protrusion 22. Here, the lead wires L are led through the outlet 25*a* or 25*b* corresponding to a winding direction thereof. That is, a lead wire L2 of the coil 50 wound in an A direction in FIG. 5 is led through the outlet 25*b* adjacent to an inclined surface Sb having an angle of 45° or less in the A direction, and a lead wire L1 of the coil 50 wound in a B direction is led through the outlet 25*a* adjacent to an inclined surface Sa having an angle of 45° or less in the B direction.

Therefore, the lead wires L of the transformer 100 according to the present embodiment maintain an angle θ of 45° or less formed by the inclined surface of the dividing protrusion 22 and the inner surface of the lower flange part 15*b*.

This configuration of the dividing protrusion 22 according to the present embodiment is designed to satisfy the safety standard (that is, underwriters laboratories (UL)) between the primary and secondary coils 51 and 52 with respect to the lead wires L led from the winding part 12.

According to the UL safety standard, when the primary and secondary coils 51 and 52 are in contact with each other, an angle formed therebetween should be set in the range of 0° to 45°. Therefore, when the angle formed by the lead wires L of the primary and secondary coils 51 and 52 is larger than 45°, the UL safety standard is not satisfied.

As described above, in the transformer 100 according to the present embodiment, the lead wires L lead to the lead wire skip part 18 and are then connected to the external connection terminals 30.

Here, when the lead wires of a specific coil (for example, lead wires of the secondary coil Ns4) are led directly from a contact surface between the primary and secondary coils 51 and 52 in a direct downward direction, they may form an angle of 90° while contacting the continuously wound coil (for example, the primary coil Np3 or Np2). In this case, the above-mentioned UL safety standard is not satisfied.

In order to solve this problem, the transformer 100 according to the present embodiment is configured such that the lead wires L are skipped to the lead wire skip part 18 along the inclined surface of the dividing protrusion 22 as described above. That is, the lead wires L are not led directly downward from the winding part 12 but are led obliquely therefrom so as to have a predetermined gradient along the inclined surface S of the dividing protrusion 22. Here, since the angle between the coils 50 wound in the winding part 12 and the inclined surface S of the dividing protrusion 22 is 45° or less as described above, the lead wires L may be led while forming an angle of 45° or less with the coils 50 wound in the winding part 12. Thereby, the above-mentioned UL safety standard may be satisfied.

Meanwhile, a general insulated coil (for example, a polyurethane wire) or the like may be used as the coils Np1 to Ns4 according to the present embodiment. A twisted pair of wires formed by twisting several strands of wire (for example, a Litz wire, or the like) may be used. In addition, a multi-insulated coil having high insulation properties (for example, a triple insulated wire (TIW)) may be used. That is, types of the coils may be selected as necessary.

Particularly, in the transformer 100 according to the present embodiment, all (or some) of the respective individual coils are formed of a multi-insulated wire such as TIW, such that insulation properties between the individual coils may be secured. Therefore, an insulating tape that has been used for insulating the coils from each other in the related art transformer may be omitted.

Multi-insulated wire is a coil of which insulation properties are increased by forming an insulator having several layers (for example, three layers) on an outer portion of a conductor. When the triple insulated coil 51*b* is used, insulation properties between a conductor and the outside are easily secured, whereby an insulation distance between the coils may be minimized. However, this multi-insulated wire has increased manufacturing costs as compared to a general insulated coil (for example, a polyurethane wire).

Therefore, in the transformer according to the present embodiment, in order to minimize manufacturing costs and reduce manufacturing processes, only any one of the primary and secondary coils 51 and 52 may be the multi-insulated coil.

The transformer according to the present embodiment configured as described above is not limited to the above-mentioned embodiments but may be variously applied.

Figure 7:
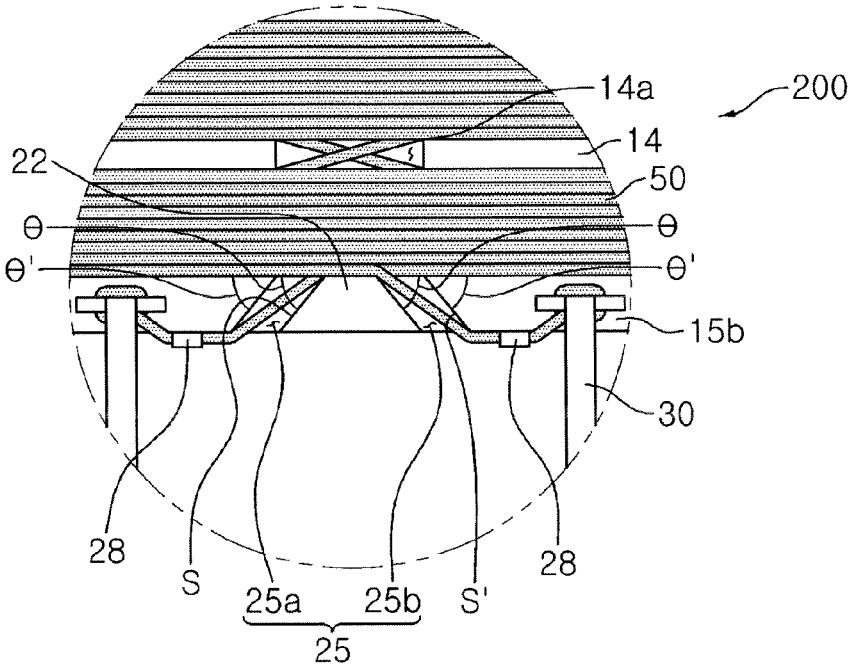
FIG. 7 is a partial side view showing a side of a transformer according to another embodiment of the present invention.

FIG. 7 is a side view showing a side of a transformer according to another embodiment of the present invention.

Referring to FIG. 7, a transformer 200 according to the present embodiment has a dividing protrusion 22 protruding from the body part 13 of the winding part 120 in the outer diameter direction thereof, unlike the dividing protrusion 22 (See FIG. 5) according to the above-described embodiments protruding from the terminal connection part 20.

Here, the dividing protrusion 22 is disposed within the lead groove 25 of the lower flange part 15*b*. More specifically, the dividing protrusion 22 may be elongated along the shape of the lead groove 25 in the outer diameter direction.

In addition, the dividing protrusion 22 has an upper surface disposed on approximately the same plane as the upper surface (that is, the inner surface) of the lower flange part 15*b*. In addition, the dividing protrusion 22 may have approximately the same thickness as that of the lower flange part 15*b*.

The center of the dividing protrusion 22 is disposed at the center of the lead groove 25 and has a width smaller than the entire width of the lead groove 25. Similar to the above-mentioned embodiment, the lead groove 25 is divided into two outlets 25*a* and 25*b* by the dividing protrusion 22.

The dividing protrusion 22 according to the present embodiment may have a trapezoidal cross section. That is, similar to the above-mentioned embodiment, sidewalls of the dividing protrusion 22 may be formed as inclined surfaces S. Here, the inclined surfaces S of the dividing protrusion 22 and the inner surface of the lower flange part 15*b* may have an angle of 45° or less formed therebetween.

In addition, the lead groove 25 according to the present embodiment may also have a trapezoidal cross section. In this case, sidewalls of the lead groove 25 facing the sidewalls of the dividing protrusion 22 may also be formed as inclined surfaces S'.

Here, the sidewall, that is, the inclined surface S', of the lead groove 25 may be parallel to the inclined surface S of the dividing protrusion 22, and an angle θ' between the inclined surface S' and the inner surface of the lower flange part 15*b* may be smaller than the angle θ between the inclined surface S and the inner surface of the lower flange part 15*b* as shown in FIG. 7. However, the present invention is not limited thereto.

Meanwhile, the configuration in which the sidewall of the lead groove 25 is formed as the inclined surface S' is not limited to the present embodiment but may also be easily applied to the above-mentioned embodiment as necessary.

Further, in the present embodiment, the lower flange part 15*b* serves as the terminal connection part 20 (See FIG. 1), unlike the above-mentioned embodiment in which the terminal connection part 20 is separately formed.

Therefore, the external connection terminals are connected to a distal end of the lower flange part 15*b*, and the catch protrusions 28 are also formed on an outer surface (that is, a lower surface) of the lower flange part 15*b* rather than the terminal connection part.

As described above, the transformer according to the embodiments of the invention may include dividing protrusions and catch protrusions formed in various shapes as necessary, as long as the coils wound in the winding part and the lead wires of the coil leading to the lead groove may have an angle of 45° or less therebetween.

Figure 8:
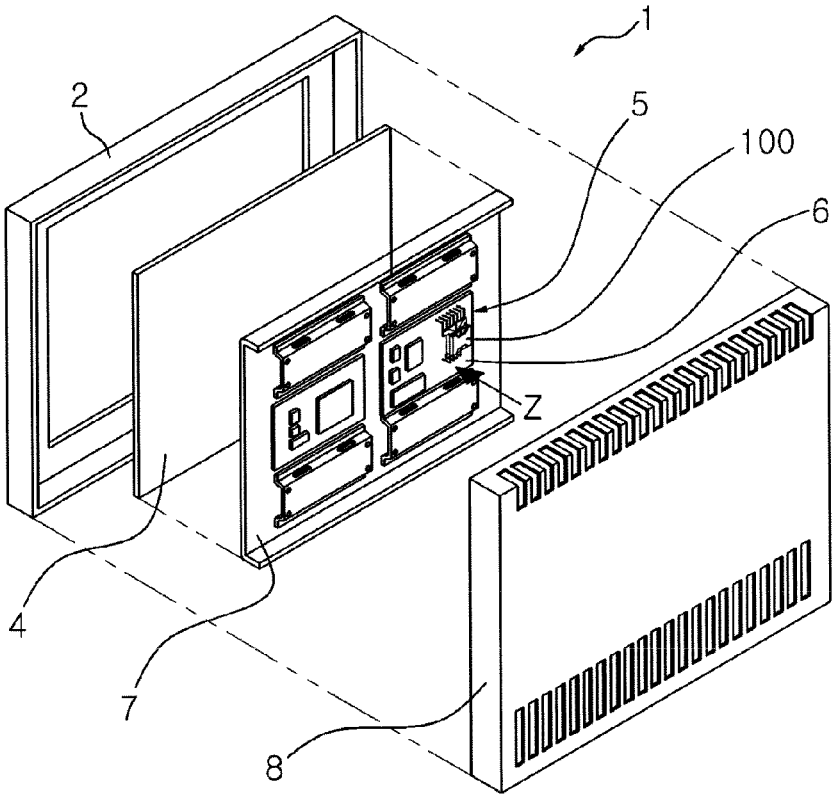
FIG. 8 is an exploded perspective view schematically showing a flat panel display device according to an embodiment of the present invention.

FIG. 8 is an exploded perspective view schematically showing a flat panel display device according to an embodiment of the present invention.

Referring to FIG. 8, a flat panel display device 1 according to an embodiment of the present invention may include a display panel 4, a switching mode power supply (SMPS) 5 having the transformer 100 mounted therein, and a cover 2 and 8.

The cover may include a front cover 2 and a back cover 8 and may be coupled to each other to thereby form an internal space therebetween.

The display panel 4 is disposed in the internal space formed by the covers 2 and 8.

As the display panel 4, various flat panel display panels such as a liquid crystal display (LCD), a plasma display panel (PDP), an organic light emitting diode (OLED), and the like, may be used.

The SMPS 5 provides power to the display panel 4. The SMPS 5 may be formed by mounting a plurality of electronic components on a printed circuit board 6 and particularly, may include at least one of the transformers 100 and 200 according to the above-mentioned embodiments mounted therein.

The SMPS 5 may be fixed to a chassis 7, and be fixedly disposed in the internal space formed by the covers 2 and 8.

Here, the transformer 100 mounted in the SMPS 5 has the coil 50 (See FIG. 1) wound in a direction that is parallel to the printed circuit board 6. In addition, when being viewed from a plane of the printed circuit board 6 (a Z direction), the coil 50 is wound clockwise or counterclockwise. Therefore, a portion (an upper surface) of the core 40 forms a magnetic path while being parallel to the back cover 8.

Therefore, in the transformer 100 according to the present embodiment, a magnetic path of most magnetic flux formed between the back cover 8 and the transformer 100 among a magnetic field generated by the coil 50 is formed in the core 40, whereby the generation of leakage magnetic flux between the back cover 8 and the transformer 100 may be minimized.

Therefore, even if the transformer 100 according to the present embodiment does not include a separate shielding device on the outside thereof, vibrations of the back cover 8 may be prevented due to interference between the leakage flux of the transformer 100 and the back cover 8 made of a metallic material.

Therefore, even if the transformer 100 is mounted in a thin electronic device such as the flat panel display device 1 and the back cover 8 and the transformer 100 have a significantly narrow space therebetween, the generation of noise due to the vibrations of the back cover 8 may be prevented.

As set forth above, in the transformer according to the embodiments of the present invention, the winding space of the bobbin is uniformly partitioned into a plurality of spaces, and the respective individual coils are wound in the partitioned spaces in a uniformly distributed scheme. In addition, the respective individual coils are wound in a stacked manner.

Therefore, a phenomenon in which the individual coils are relatively more wound in any one side or are non-uniformly wound while being spaced apart from each other within the winding part may be prevented. As a result, leakage inductance generated due to the non-uniform winding of the coils may be minimized.

In addition, in the transformer according to the embodiments of the present invention, the lead wires of the coils are not disposed within the winding part but directly lead to the outside of the winding part through the catch groove. Therefore, the coils wound in the winding part may be uniformly wound, whereby leakage inductance due to the bending of the coils, or the like, may be minimized.

Further, since the transformer according to the embodiments of the present invention includes the lead wire skip part, exposure of the lead wires to the outside may be minimized, whereby damages of the lead wires due to physical contact between the lead wire and the outside may be prevented.

Furthermore, in the transformer according to the embodiments of the present invention, the lead wires of the coil are led obliquely so as to have a predetermined gradient along the inclined surface of the dividing protrusion or the lead groove, such that they may be led while forming an angle of 45° or less with the coils wound in the winding part. Therefore, the UL safety standard may be easily satisfied. In addition, the transformer according to the embodiments of the present invention includes the plurality of catch protrusions, whereby a direction in which the lead wires are disposed may be easily altered.

In addition, when the transformer according to the embodiments of the present invention is mounted on the substrate, the coil of the transformer is maintained in a state in which it is wound parallel to the substrate. When the coil is wound parallel to the substrate as described above, interference between the leakage magnetic flux generated from the transformer and the outside may be minimized.

Therefore, even if the transformer is mounted in a thin display device, the generation of interference between the leakage magnetic flux generated from the transformer and the back cover of the display device may be minimized. Therefore, the generation of noise in the display device by the transformer may be prevented. Therefore, the transformer may also be easily used in thin display devices.

The above-described transformer is not limited to the above-mentioned embodiments but may be variously applied. For example, the above-mentioned embodiments describe a case in which the flange part and the partition wall of the bobbin have a rectangular shape by way of example. However, the present invention is not limited thereto. That is, the flange part and the partition wall of the bobbin may also have various shapes such as a circular shape, an ellipsoidal shape, or the like, as necessary.

In addition, although the above-mentioned embodiments describe a case in which the body part of the bobbin has a circular cross section by way of example, the present invention is not limited thereto but may be variously applied. For example, the body part of the bobbin may have an ellipsoidal cross section or a polygonal cross section.

Further, although the above-mentioned embodiments describe a case in which the terminal connection part is formed under the lower flange part by way of example, the present invention is not limited thereto but may be variously applied. For example, the terminal connection part may also be formed over the upper flange part.

In addition, although the above-mentioned embodiments describe a case in which the dividing protrusion has the inclined surface by way of example, the present invention is not limited thereto but may be variously applied. For example, when the lead groove has a sufficiently wide width, the inclined surface of the dividing protrusion is omitted, and only the sidewall of the lead groove may be formed as the inclined surface.

Moreover, although the above-mentioned embodiments describe the insulating type switching transformer by way of example, the present invention is not limited but may be widely applied to any transformer, coil component, and electronic device including a plurality of coils wound thereabout.

While the present invention has been shown and described in connection with the exemplary embodiments, it will be apparent to those skilled in the art that modifications and variations can be made without departing from the spirit and scope of the invention as defined by the appended claims.

What is claimed is:

1. A transformer comprising:

a winding part including a pipe shaped body part and flange parts extended from both ends of the body part in an outer diameter direction thereof; and a plurality of coils wound around an outer peripheral surface of the body part while being stacked thereon, wherein one of the flange parts disposed at one end of a winding part includes at least one lead groove therein, the lead groove being cut to be extended in the outer diameter direction, and the lead groove is divided into at least two outlets by a dividing protrusion disposed in an inner portion thereof, wherein the dividing protrusion has a trapezoidal cross section, when viewed along a plane tangential to the pipe shaped body part such that a width of the trapezoidal cross section of the dividing protrusion gradually increases in a direction toward an external surface of the flange part, wherein the trapezoidal cross section of the dividing protrusion has a sidewall having an inclined surface facing a sidewall of the lead groove, wherein the inclined surface forming the sidewall of the dividing protrusion has an angle of 45° or less with respect to the coils wound in the winding part.

2. The transformer of claim 1, further comprising a terminal connection part extended from an end of the winding part by a predetermined distance and including a plurality of external connection terminals connected thereto, wherein the dividing protrusion protrudes from the terminal connection part toward the lead groove.

3. The transformer of claim 2, wherein the dividing protrusion has a distal end disposed within the lead groove, and has a larger cross-sectional area in a portion thereof adjacent to the terminal connection part than in a portion thereof adjacent to the distal end thereof.

4. The transformer of claim 3, wherein a surface of the dividing protrusion disposed by the distal end thereof is disposed on the same plane as an inner surface of the flange part having the lead groove formed therein.

5. The transformer of claim 2, further comprising a catch protrusion protruding from at least one of the terminal connection part and the flange part, wherein lead wires of the coils led through the lead groove are disposed in an altered direction while being supported by the catch protrusion.

6. The transformer of claim 1, wherein the outlets and the coils wound in the winding part have an angle of 45° or less formed therebetween.

7. The transformer of claim 6, wherein lead wires of the coils lead to the outside of the winding part through the outlets formed in a coil winding direction.

8. The transformer of claim 1, wherein the terminal connection part includes at least one catch groove extended from the lead groove and cut to have a width extended beyond that of the lead groove in a coil winding direction, and lead wires of the coils lead to the outside while traversing the catch groove in a length direction thereof.

9. The transformer of claim 1, wherein the dividing protrusion protrudes from an outer surface of the body part in the outer diameter direction thereof.

10. The transformer of claim 9, wherein the dividing protrusion has the same thickness as that of the flange part having the lead groove formed therein.

11. The transformer of claim 9, wherein the dividing protrusion has a sidewall having an inclined surface facing a sidewall of the lead groove.

12. The transformer of claim 9, further comprising external connection terminals connected to a distal end of the flange part having the lead groove formed therein, to thereby be electrically connected to lead wires of the coils.

13. The transformer of claim 1, wherein at least one of a sidewall of the lead groove and a sidewall of the dividing protrusion facing each other is formed as an inclined surface.

14. The transformer of claim 13, wherein the inclined surface has an angle of 45° or less with respect to the coils wound in the winding part.

15. The transformer of claim 1, wherein the winding part includes a plurality of winding spaces divided by at least one partition wall formed on the outer peripheral surface of the body part, and the coils are wound in the plurality of winding spaces partitioned by the at least one partition wall in a distributed scheme.

16. The transformer of claim 15, wherein the coils include a plurality of primary coils and a plurality of secondary coils, and the plurality of secondary coils are continuously wound to be stacked while being interposed between the plurality of primary coils.

17. A display device comprising:

a power supply including at least one transformer of claim 1 mounted on a substrate thereof;

a display panel receiving power from the power supply; and a cover protecting the display panel and the power supply.

18. The display device of claim 17, wherein the coils of the transformer are wound so as to be parallel to the substrate of the power supply.

* * * * *